US009810037B2

(12) United States Patent
Reinhardt

(10) Patent No.: US 9,810,037 B2
(45) Date of Patent: Nov. 7, 2017

(54) SHEAR THICKENING FLUID CONTROLLED TOOL

(71) Applicant: Weatherford Technology Holdings, LLC, Houston, TX (US)

(72) Inventor: Paul Andrew Reinhardt, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/922,297

(22) Filed: Oct. 26, 2015

(65) Prior Publication Data

US 2016/0123105 A1 May 5, 2016

Related U.S. Application Data

(60) Provisional application No. 62/072,224, filed on Oct. 29, 2014.

(51) Int. Cl.

| | |
|---|---|
| ***E21B 33/126*** | (2006.01) |
| ***E21B 33/129*** | (2006.01) |
| ***E21B 33/128*** | (2006.01) |
| ***E21B 34/00*** | (2006.01) |
| ***H01B 3/20*** | (2006.01) |
| ***E21B 33/12*** | (2006.01) |

(52) U.S. Cl.

CPC ..... *E21B 33/129* (2013.01); *E21B 33/1208* (2013.01)

(58) Field of Classification Search

None

See application file for complete search history.

(56) References Cited

U.S. PATENT DOCUMENTS

| | | | |
|---|---|---|---|
| 2,125,665 | A | 8/1938 | Bettis |
| 2,652,894 | A | 9/1953 | Brown et al. |
| 3,147,016 | A | 9/1964 | Traufler |
| 3,215,208 | A | 11/1965 | Tamplen |
| 3,227,462 | A | 1/1966 | Tamplen |
| 3,278,192 | A | 10/1966 | Tamplen |
| 3,374,838 | A | 3/1968 | Current |
| 3,631,926 | A | 1/1972 | Young |
| 3,784,214 | A | 1/1974 | Tamplen |
| 4,482,086 | A | 11/1984 | Wagner et al. |
| 4,588,029 | A | 5/1986 | Blizzard |
| 4,753,444 | A | 6/1988 | Jackson et al. |
| 4,757,860 | A | 7/1988 | Reimert |

(Continued)

FOREIGN PATENT DOCUMENTS

| | | |
|---|---|---|
| RU | 1 367 586 | 11/1996 |

*Primary Examiner* — Matthew R Buck
*Assistant Examiner* — Douglas S Wood
(74) *Attorney, Agent, or Firm* — Patterson & Sheridan, L.L.P.

(57) ABSTRACT

A tool for use in a wellbore comprising a seal assembly and a cone member configured to force the seal assembly radially outward into engagement with the wellbore. A shear thickening fluid is disposed within an area formed between the seal assembly and the cone member. The shear thickening fluid is configured to prevent relative movement between the cone member and the seal assembly when the shear thickening fluid is changed from a substantially fluid state to a substantially solid state due to a sudden force applied to the shear thickening fluid, by release of a sheared mechanism for example.

19 Claims, 7 Drawing Sheets

(56) References Cited

U.S. PATENT DOCUMENTS 4,809,989 A 3/1989 Kernal
4,842,061 A 6/1989 Nobileau
5,052,483 A 10/1991 Hudson
5,076,356 A 12/1991 Reimert
5,311,938 A 5/1994 Hendrickson et al.
5,333,692 A 8/1994 Baugh et al.
5,355,961 A 10/1994 Gariepy et al.
5,433,269 A 7/1995 Hendrickson
5,462,121 A 10/1995 Schmuck et al.
5,467,822 A 11/1995 Zwart
5,511,620 A 4/1996 Baugh et al.
5,603,511 A 2/1997 Keyser, Jr. et al.
5,685,369 A 11/1997 Ellis et al.
5,857,520 A 1/1999 Mullen et al.
6,123,148 A 9/2000 Oneal
6,142,227 A 11/2000 Hiorth et al.
6,226,717 B1 * 5/2001 Reuter ..... G06F 9/524 711/147
6,409,175 B1 6/2002 Evans et al.
6,425,444 B1 7/2002 Metcalfe et al.
6,446,717 B1 * 9/2002 White ..... E21B 33/1212 166/187
6,666,276 B1 12/2003 Yokley et al.
6,691,789 B2 2/2004 Jackson et al.
6,705,615 B2 3/2004 Milberger et al.
6,763,893 B2 7/2004 Braddick
6,769,491 B2 8/2004 Zimmerman et al.
6,772,844 B2 8/2004 Lloyd et al.
6,789,622 B1 9/2004 Ducasse et al.
6,814,143 B2 11/2004 Braddick
6,902,008 B2 6/2005 Hirth et al.
6,962,206 B2 11/2005 Hirth et al.
7,036,581 B2 5/2006 Trahan
7,165,622 B2 1/2007 Hirth et al.
7,172,029 B2 2/2007 Hirth et al.
7,213,814 B2 5/2007 Hurlbert et al.
7,225,880 B2 6/2007 Braddick
7,234,533 B2 6/2007 Gambier
7,252,142 B2 8/2007 Brezinski et al.
7,322,422 B2 1/2008 Patel
7,360,592 B2 4/2008 McMahan
7,367,404 B2 5/2008 Simpson et al.
7,370,708 B2 5/2008 Simpson et al.
7,380,592 B2 6/2008 Atkins et al.
7,387,170 B2 6/2008 Doane et al.
7,407,165 B1 8/2008 Chisnell
7,441,606 B2 10/2008 Maguire
7,469,750 B2 12/2008 Carr
7,493,945 B2 2/2009 Doane et al.
7,665,532 B2 2/2010 Cook et al.
7,703,542 B2 4/2010 O'Connor et al.
7,740,248 B2 6/2010 Keene et al.
7,748,467 B2 7/2010 Doane
7,766,088 B2 8/2010 Saucier et al.
7,775,290 B2 8/2010 Brisco et al.
7,779,927 B2 8/2010 Turley et al.
7,784,797 B2 8/2010 Baugh et al.
7,921,921 B2 4/2011 Bishop et al.
8,066,065 B2 11/2011 Buckner
8,109,340 B2 2/2012 Doane et al.
8,459,347 B2 6/2013 Stout
2002/0088616 A1 7/2002 Swor et al.
2002/0121380 A1 9/2002 Doane et al.
2002/0148612 A1 10/2002 Cook et al.
2004/0060706 A1 4/2004 Stephenson
2004/0123983 A1 7/2004 Cook et al.
2005/0172472 A1 8/2005 Verger et al.
2005/0173110 A1 8/2005 Trahan
2006/0186602 A1 8/2006 Martin et al.
2006/0272827 A1 12/2006 Adam et al.
2007/0151725 A1 7/2007 Cook et al.
2009/0205843 A1 8/2009 Gandikota et al.
2009/0286910 A1 * 11/2009 Bloomfield ..... C08L 21/00 524/269
2010/0089591 A1 4/2010 Thomson et al.
2011/0037230 A1 2/2011 O'Connor et al.
2013/0269956 A1 10/2013 Yee
2013/0292138 A1 11/2013 Givens et al.
2015/0167424 A1 * 6/2015 Richards ..... E21B 33/134 166/386

* cited by examiner

SHEAR THICKENING FLUID CONTROLLED TOOL

CROSS REFERENCE TO RELATED APPLICATION

This application claims benefit of U.S. Provisional Application Ser. No. 62/072,224, filed Oct. 29, 2014, the contents of which are herein incorporated by reference in their entirety.

BACKGROUND

Field of the Disclosure

Embodiments of this disclosure generally relate to controlling the operation of a tool using a shear thickening fluid.

Description of the Related Art

Controlling the operation of a tool that is located in a wellbore is problematic when different functions of the tool are actuated by different forces and/or pressure levels. For example, large volumes of fluid are pumped from the surface to pressurize the tool to obtain a predetermined pressure level, thereby actuating the tool to perform a specific function. When the tool is actuated, however, an impact force generated by the sudden release of the pressurized fluid can inadvertently cause the actuation of another function of the tool, unknowingly to an operator of the tool. The inadvertent actuation, e.g. the malfunction, of the tool causes confusion and potentially failure of the tool to perform subsequent functions.

One attempt to address inadvertent actuation of the tool includes spacing the forces and/or pressure levels that actuate the tool at large differences from each other. Another attempt includes using a choke or a dampening means to absorb the energy release of the pressurized fluid. Additional attempts include running smaller volume inner strings to minimize accumulation effects, or alternating hydraulic functions with mechanical/pneumatic/electrical initiated functions. These prior attempts each have many drawbacks.

Therefore, there is a continuous need for new and improved apparatus and methods for controlling the operation of wellbore tools.

SUMMARY

In one embodiment, a tool for use in a wellbore comprises a seal assembly; a cone member configured to force the seal assembly radially outward into engagement with the wellbore; and a shear thickening fluid disposed within an area formed between the seal assembly and the cone member.

In one embodiment, a method of controlling a tool in a wellbore comprises transmitting a force from a cone member to a seal assembly, wherein a shear thickening fluid is disposed within an area formed between the cone member and the seal assembly; changing the shear thickening fluid from a substantially fluid state to a substantially solid state; and preventing relative movement between the cone member and the seal assembly by changing the shear thickening fluid from the substantially fluid state to the substantially solid state.

BRIEF DESCRIPTION OF THE DRAWINGS

So that the manner in which the above recited features can be understood in detail, a more particular description of the embodiments briefly summarized above may be had by reference to the embodiments described below, some of which are illustrated in the appended drawings. It is to be noted, however, that the appended drawings illustrate only typical embodiments and are therefore not to be considered limiting of its scope, for the embodiments may admit to other equally effective embodiments.

DETAILED DESCRIPTION

Figure 1:
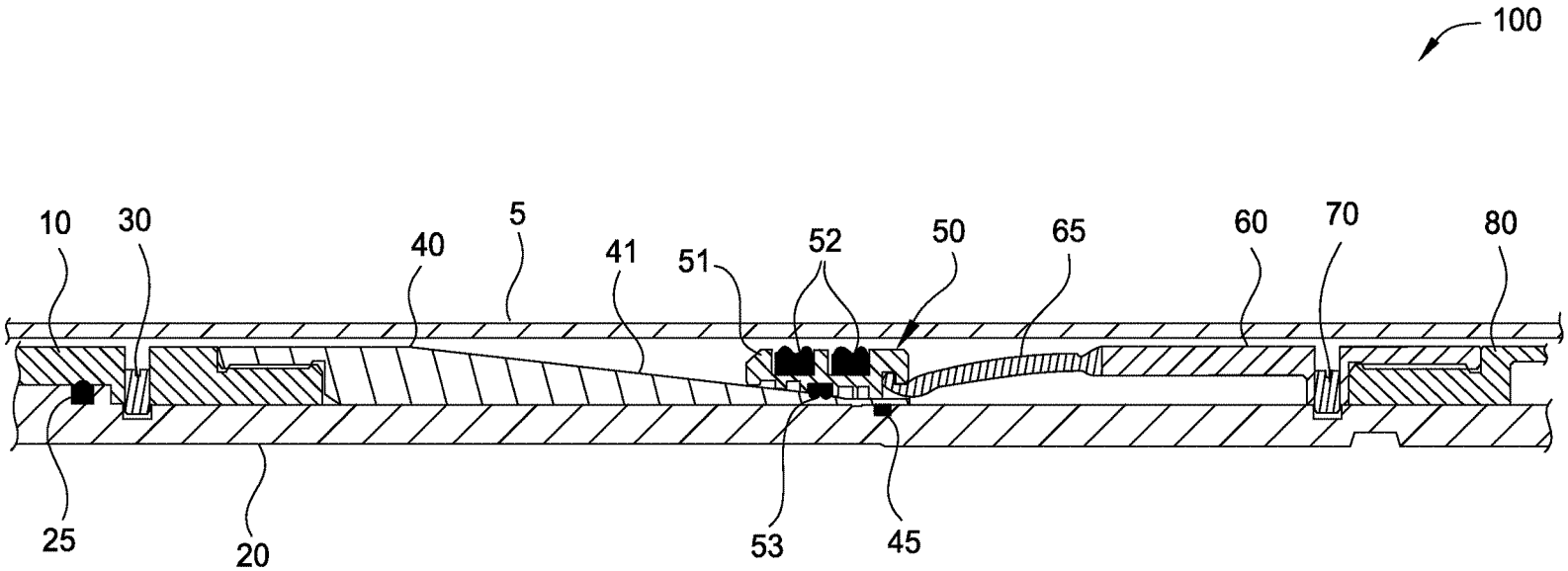
FIG. 1 illustrates a portion of a tool for use in a wellbore, according to one embodiment disclosed herein.

FIG. 1 illustrates a portion of a tool 100 for use in a wellbore, such as to provide a seal within a casing 5, according to one embodiment disclosed herein. The tool 100 is actuated into different operational positions by applying one or more mechanical, hydraulic, pneumatic, and/or electrical forces to the tool 100. The tool 100 may be an anchor, a liner hanger, or any other type of tool used in wellbore operations.

The tool 100 includes an upper mandrel 10 releasably coupled to an inner mandrel 20 by a first releasable member 30. A seal 25 is disposed between the upper mandrel 10 and the inner mandrel 20. The upper mandrel 10 is also coupled to an actuation assembly comprising a cone member 40 having a tapered surface 41. A seal 45 is disposed between the cone member 40 and the inner mandrel 20.

A seal assembly 50 is positioned at the base of the tapered surface 41 of the cone member 40. The seal assembly 50 includes two outer seals 52 and an inner seal 53 supported by a seal carrier 51. The outer and inner seals 52, 53 may be the primary seals that seal against the casing 5 and the cone member 40, respectively, during operation of the tool 100. The seal assembly 50 is coupled to an outer mandrel 60 by a collet member 65. The outer mandrel 60 is releasably coupled to the inner mandrel 20 by a second releasable member 70. The outer mandrel 60 is also coupled to a lower mandrel 80, which is disposed on the inner mandrel 20.

Figure 2:
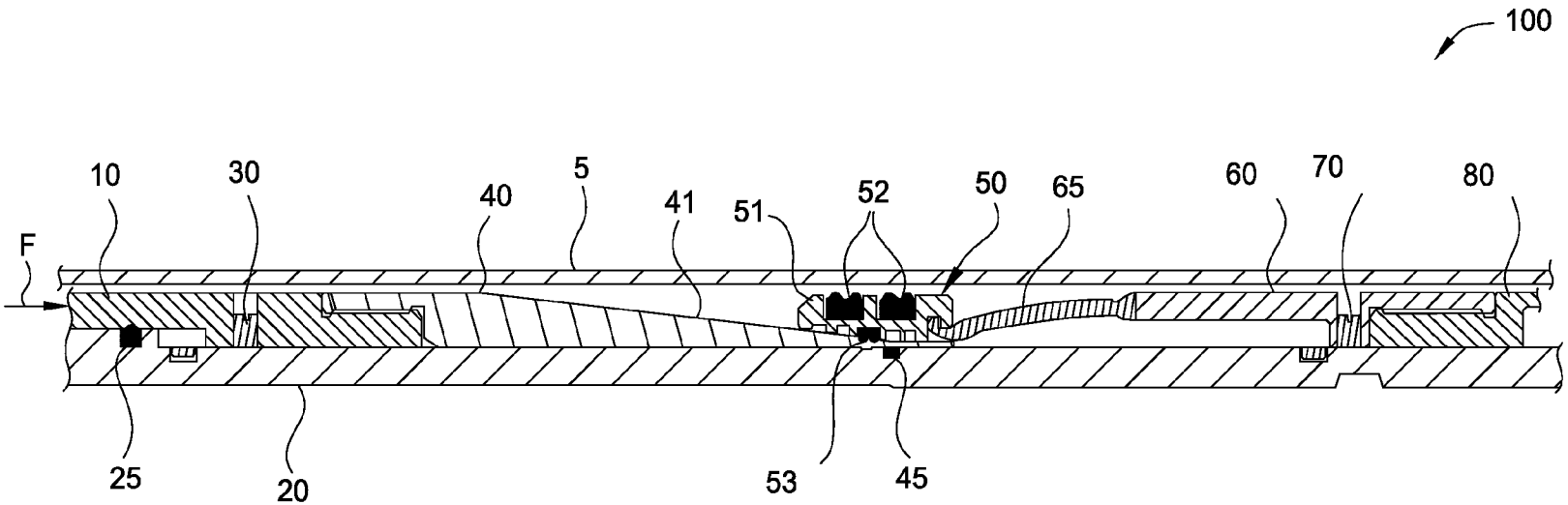
FIG. 2 illustrates a portion of the tool when actuated into a correct operational position, according to one embodiment disclosed herein.

FIG. 2 illustrates the tool 100 when correctly actuated into a first operational position, according to one embodiment disclosed herein. A force (identified by reference arrow "F") is applied to the upper mandrel 10 to shear the first releasable member 30. The origin of the force may be a mechanical, hydraulic, pneumatic, and/or electrical force applied to the tool 100. When the first releasable member 30 is sheared, the force is transmitted through the cone member 40, the seal assembly 50, the collet member 65, and the outer mandrel 60, to shear the second releasable member 70. The amount of force required to shear the second releasable member 70 is less than the amount of force required to overcome friction between the seal assembly 50 and the tapered surface 41 of the cone member 40. When properly applied, the force (identified by reference arrow "F") is transmitted from the cone member 40 to the seal assembly 50, without wedging the cone member 40 underneath the seal assembly 50 and inadvertently expanding the seal assembly 50 into contact with the casing 5 at this stage in the operation of the tool 10.

When the second releasable member 70 is sheared, the upper mandrel 10, the cone member 40, the seal assembly 50, the collet member 65, the outer mandrel 60, and the lower mandrel 80 are movable relative to the inner mandrel 20. The force (identified by reference arrow "F") moves the upper mandrel 10, the cone member 40, the seal assembly 50, the collet member 65, the outer mandrel 60, and the lower mandrel 80 to position the tool 100 into the first operational position. The tool 100 is actuated into the first operational position to perform a desired function (e.g. to actuate a slip assembly into engagement with the surrounding wellbore) and/or to place the tool 100 in a desired condition for actuation into a second operational position. Subsequently, at the appropriate time, another force can be applied to the cone member 40 to radially expand the seal assembly 50 by forcing the tapered surface 41 of the cone member 40 under the seal assembly 50.

Figure 3:
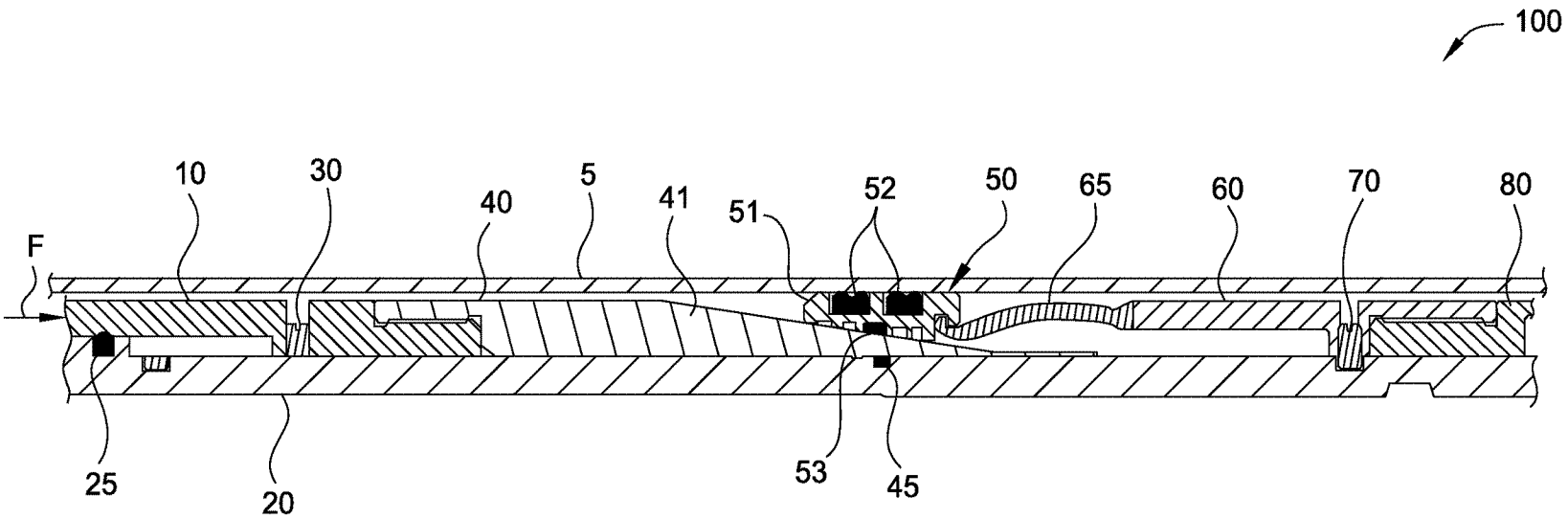
FIG. 3 illustrates a portion of the tool when inadvertently actuated into an incorrect operational position, according to one embodiment disclosed herein.

FIG. 3 illustrates the tool 100 when inadvertently actuated into an incorrect position, according to one embodiment disclosed herein. The force (identified by reference arrow "F") is applied to the upper mandrel 10 to shear the first releasable member 30. When the first releasable member 30 is sheared, the sudden release of the force applied to the first releasable member 30 impacts the cone member 40 with an amount of force that wedges the cone member 40 underneath the seal assembly 50 prior to transmitting the force to collet member 65 and the outer mandrel 60 to shear the second releasable member 70. The radial expansion of the seal assembly 50 by the cone member 40 prior to shearing of the second releasable member 70 results in a malfunction of the tool 100.

As illustrated in FIG. 3, the seal assembly 50 is forced radially outward into engagement with the casing 5 by the tapered surface 41 of the cone member 40, and the second releasable member 70 is not yet sheared. Any subsequent amount of force applied to the upper mandrel 10 to attempt to shear the second releasable member 70 may be transmitted from the seal assembly 50 to the surrounding wellbore via the casing 5 and/or may damage the seal assembly 50. With the tool 100 in the position illustrated in FIG. 3, subsequent actuation of the tool 100 is prevented without conducting a remedial operation or potentially damaging the tool 100.

Figure 4:
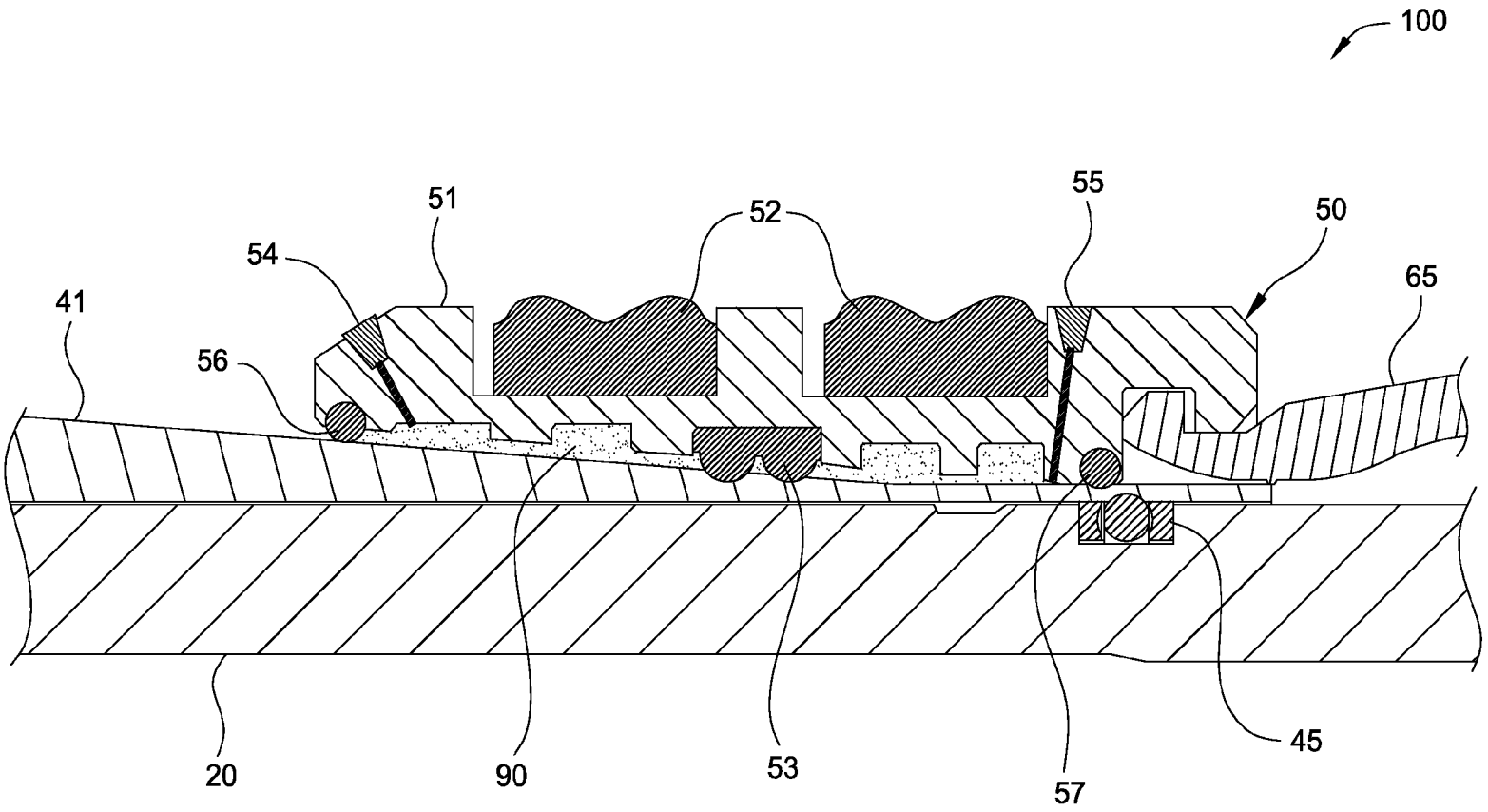
FIG. 4 illustrates an enlarged view of a modified portion of the tool, according to one embodiment disclosed herein.

FIG. 4 illustrates an enlarged view of a modified portion of the tool 100, according to one embodiment disclosed herein. A shear thickening fluid 90 (also known as a dilatant fluid) is disposed within the area formed between the inner surface of the seal carrier 51 and the outer surface of the cone member 40. The shear thickening fluid 90 may comprise a non-Newtonian fluid. In the shear thickening fluid 90, the relationship between the shear stress and the rate of shear strain is non-linear. One or more forces, when applied to the shear thickening fluid 90 under certain conditions, can cause the shear thickening fluid 90 to change from a substantially fluid state to a substantially solid state. For example, one or more compression forces, tension forces, torsion-type forces, and/or shear forces when suddenly applied to the shear thickening fluid 90 can cause the shear thickening fluid 90 to change from a substantially fluid state to a substantially solid state.

The shear thickening fluid 90 is configured to prevent relative movement between the cone member 40 and the seal assembly 50 when changed from a substantially fluid state to a substantially solid state due to a sudden force applied to the shear thickening fluid 90. Relative movement between the cone member 40 and the seal assembly 50 may exist if the force acting on the shear thickening fluid 90 is gradually applied, allowing the assembly and disassembly of the components of the tool 100. The operation of the shear thickening fluid 90 as disclosed herein can be used on other wellbore tools, including but not limited to an anchor and/or a liner hanger.

A first seal 56 and a second seal 57 are positioned at opposite ends of the seal carrier 51. The first and second seals 56, 57 may seal against the tapered surface 41 of the cone member 40 to contain the shear thickening fluid 90. The first and second seals 56, 57 may be flexible seal members that allow for expansion and/or contraction of the shear thickening fluid 90 due to thermal and/or hydrostatic effects. The shear thickening fluid 90 is supplied through one or more ports 54, 55 (formed through the seal carrier 51 and disposed on opposite sides of the inner seal 53) to fill the area between the seal assembly 50 and the cone member 40. In one embodiment, the shear thickening fluid 90 comprises silicon suspended in glycol.

The shear thickening fluid 90 is configured to allow relative movement between the tapered surface 41 of the cone member 40 and the seal assembly 50 when a non-impacting force (e.g. a force gradually applied to the cone member 40) is applied to the cone member 40, but prevent the cone member 40 from moving relative to the seal assembly 50 when an impacting force (e.g. a force suddenly applied to the cone member 40) is applied to the cone member 40. A sudden impact applied to the cone member 40 (such as shearing of the first releasable member 30 illustrated in FIG. 3) may move the cone member 40 relative to the seal assembly 50 such that the volume of the area within which the shear thickening fluid 90 is disposed is rapidly reduced, thereby causing the shear thickening fluid 90 to become suddenly compressed with a force that causes the shear thickening fluid 90 to instantaneously thicken and become substantially solid. The compression force suddenly applied to the shear thickening fluid 90 changes the shear thickening fluid 90 from a substantially fluid state to a substantially solid state.

Specifically, the volume of the area between the seal member 50 and the cone member 40 decreases as the seal member 50 is forced up along the tapered surface 41 of the cone member 40. The instantaneous thickening of the shear thickening fluid 90 from a substantially fluid state to a substantially solid state causes the cone member 40 and the seal assembly 50 to grip each other and act as one solid component, so that the cone member 40 does not inadvertently move relative to the seal assembly 50. However, a non-impacting force that is gradually applied to the cone member 40 does not generate the sudden compressive force that would instantaneously thicken the shear thickening fluid 90, thereby maintaining the shear thickening fluid 90 in a substantially fluid state and allowing the cone member 40 to move relative to the seal assembly 50 to set the seal assembly 50 when desired.

Figure 5A:
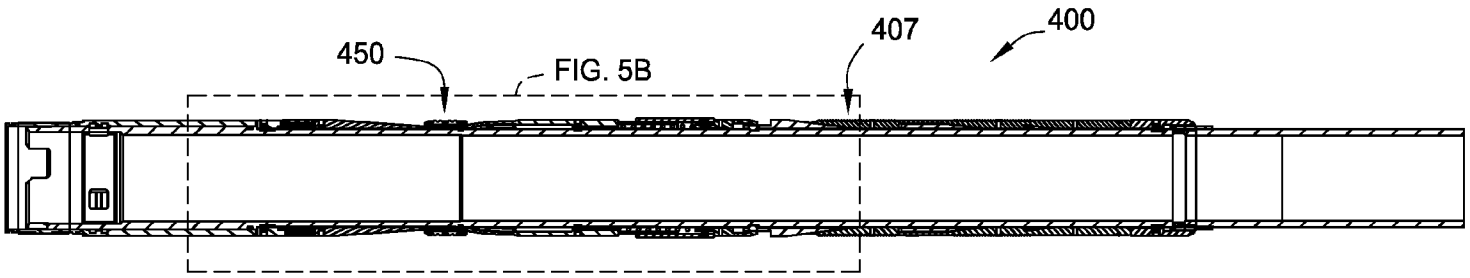
FIG. 5A, FIG. 5B, FIG. 5C, and FIG. 5D illustrate the tool in run-in and set positions, according to one embodiment disclosed herein.
Figure 5B:
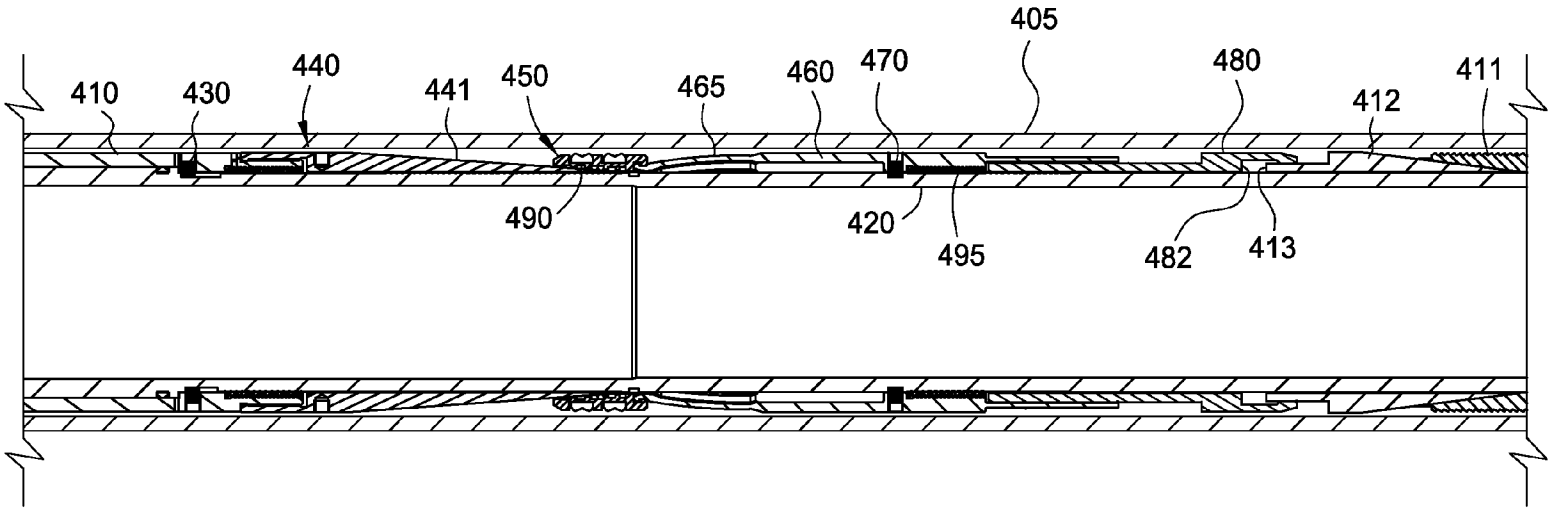

FIG. 5A and FIG. 5B illustrate a tool 400 in a run-in position and used to seal against a casing 405 at a desired location in a wellbore. The tool 400 includes a seal assembly 450 and a slip assembly 407. The seal assembly 450 comprises the seal assembly 50 illustrated in FIG. 4, including shear thickening fluid 490 disposed within the area between the seal assembly 450 and an upper tapered surface 441 of a cone member 440. The cone member 440 is coupled to an upper mandrel 410, which is coupled to the inner mandrel 420 by a first releasable member 430.

A collet member 465 is coupled to the seal assembly 450 at one end, and to an outer mandrel 460 at an opposite end. The outer mandrel 460 is coupled to the inner mandrel 420 by a second releasable member 470. A lock ring 495 is disposed between the outer mandrel 460 and the inner mandrel 420, which allows movement of the outer mandrel 460 in the direction toward the slip assembly 407 and prevents movement of the outer mandrel 460 in the opposite direction.

The outer mandrel 460 is coupled to or engages a lower mandrel 480, which engages a wedge member 412. The wedge member 412 is movable relative to the inner mandrel 420 to move one or more slips 411 of the slip assembly 407 outward into engagement with the casing 405. Specifically, a surface 482 of the lower mandrel 480 contacts an end surface 413 of the wedge member 412 to move the wedge member 412 underneath the slips 411 and force the slips 411 radially outward into contact with the casing 405.

Figure 5C:
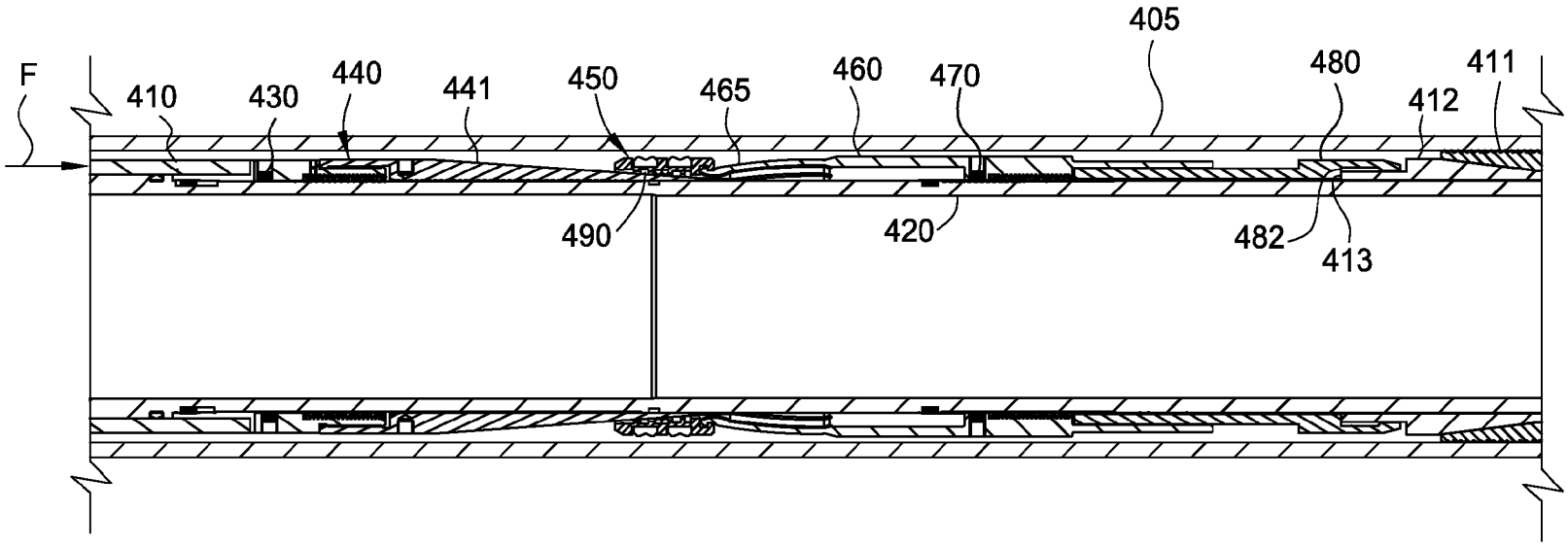

FIG. 5C illustrates the tool 400 in a first set position. To move the tool 400 to the first set position, a force (identified by reference arrow "F") is applied to the upper mandrel 410 to shear the first releasable member 430. The force applied to the tool 400 may be a mechanical, hydraulic, pneumatic, and/or electrical force. When the first releasable member 430 is sheared, the force is transmitted from the upper mandrel 410 to the cone member 440, the seal assembly 450, the collet member 465, and the outer mandrel 460 to shear the second releasable member 470. When properly applied, the force is transmitted from the cone member 440 to the seal assembly 450, without forcing the cone member 440 underneath the seal assembly 450.

The amount of force required to shear the second releasable member 470 is less than the amount of force required to overcome friction between the seal assembly 450 and the tapered surface 441 of the cone member 440. However, in the event that the shearing of the first releasable member 430 suddenly imparts a greater force to the cone member 440, the shear thickening fluid 490 disposed between the seal assembly 450 and the tapered surface 441 of the cone member 440 will prevent inadvertent movement of the cone member 440 relative to the seal assembly 450. As similarly described above with respect to FIG. 4, a compressive force applied to the shear thickening fluid 490 (due to the reduced volume of the area where the shear thickening fluid 490 is disposed as the cone member 440 is suddenly forced underneath the seal assembly 450) immediately causes the shear thickening fluid 490 to thicken and become substantially solid. When in a substantially solid state, the shear thickening fluid 490 stops the cone member 440 from moving any further relative to the seal assembly 450.

When the second releasable member 470 is sheared, the upper mandrel 410, the cone member 440, the seal assembly 450, the collet member 465, the outer mandrel 460, and the lower mandrel 480 are movable together relative to the inner mandrel 420. The force moves the upper mandrel 410, the cone member 440, the seal assembly 450, the collet member 465, the outer mandrel 460, and the lower mandrel 480 until the surface 482 of the lower mandrel 480 contacts the end surface 413 of the wedge member 412. The wedge member 412 is forced underneath the slips 411 to force the slips 411 radially outward into engagement with the casing 405. Wellbore fluids can be circulated back up to the surface around the set slips 411 and the seal assembly 450 (which has not yet been set) to allow for the displacement of a slurry, such as cement.

Figure 5D:
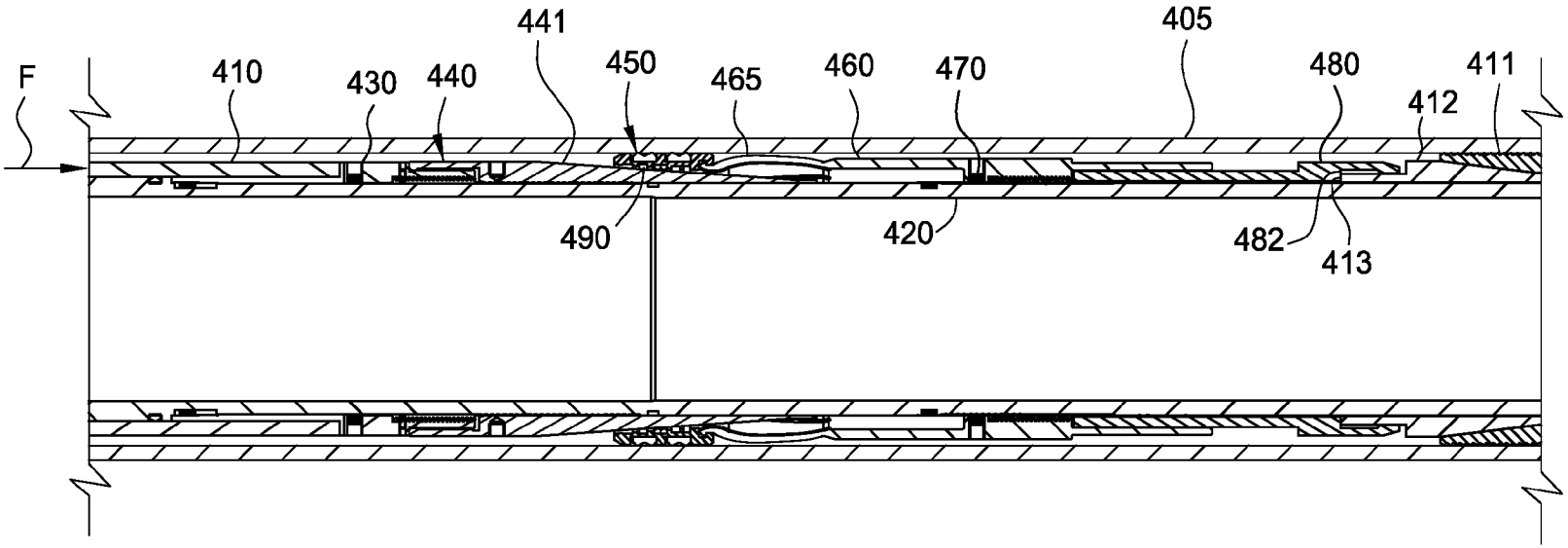

FIG. 5D illustrates the tool 400 in a subsequent, second set position. The same or a different force can be applied or continued to be applied to the upper mandrel 410 to force the cone member 440 underneath the seal assembly 450 (which is prevented from moving downward due to the engagement of the slips 411 with the casing 405), to expand the seal assembly 450 radially outward into engagement with the casing 405. The same or different force applied to the cone member 440 can be controlled (e.g. gradually applied) to maintain the shear thickening fluid 490 in a substantially fluid state to allow the cone member 440 to move relative to the seal assembly 450 when desired.

One advantage of using the shear thickening fluid is that the different forces and/or pressure levels required to actuate the tools 100, 400 do not have to be separated by large differences, which can allow more functions to be implemented in the tools 100, 400. Another advantage is that additional dampening mechanisms, such as a choke, do not need to be used within the tools 100, 400, which are susceptible to flow restriction and plugging. Another advantage is that smaller volume inner strings may not be needed, and/or alternating mechanical/pneumatic/electrical initiated functions may not be needed, which saves time and costs and reduces complexity of tool operation.

While the foregoing is directed to certain embodiments, other and further embodiments may be devised without departing from the basic scope thereof, and the scope thereof is determined by the claims that follow.

We claim:

1. A tool for use in a wellbore, comprising:

a seal assembly;

a frustoconical member configured to force the seal assembly radially outward into engagement with the wellbore; and a shear thickening fluid disposed within a volume bounded by the seal assembly and the frustoconical member such that the shear thickening fluid directly contacts the seal assembly and the frustoconical member.

2. The tool of claim 1, wherein the seal assembly comprises a seal carrier, a first seal, and a second seal, and wherein the shear thickening fluid is contained within the volume by the first and second seals.

3. The tool of claim 2, wherein the first and second seals are flexible seal members configured to contain the shear thickening fluid within the volume while allowing for contraction and expansion of the shear thickening fluid.

4. The tool of claim 3, wherein the seal carrier comprises one or more ports for supplying the shear thickening fluid into the volume.

5. The tool of claim 1, wherein the shear thickening fluid comprises silicon suspended in glycol.

6. The tool of claim 1, wherein the frustoconical member is movable relative to the seal assembly when the shear thickening fluid is in a substantially fluid state.

7. The tool of claim 1, wherein the frustoconical member is prevented from moving relative to the seal assembly when the shear thickening fluid is in a substantially solid state.

8. The tool of claim 1, wherein the volume is reduced as the frustoconical member is moved underneath the seal assembly, thereby compressing the shear thickening fluid.

9. The tool of claim 1, wherein the shear thickening fluid is compressed when the frustoconical member is moved relative to the seal assembly.

10. A method of controlling a tool in a wellbore, comprising:

transmitting a force from a frustoconical member to a seal assembly, wherein a shear thickening fluid is disposed within a volume bounded by the frustoconical member and the seal assembly such that the shear thickening fluid directly contacts the frustoconical member and the seal assembly;

changing the shear thickening fluid from a substantially fluid state to a substantially solid state; and preventing relative movement between the frustoconical member and the seal assembly by changing the shear thickening fluid from the substantially fluid state to the substantially solid state.

11. The method of claim 10, wherein the shear thickening fluid is changed from the substantially fluid state to the substantially solid state by applying a compression force to the shear thickening fluid.

12. The method of claim 10, further comprising containing the shear thickening fluid in the volume by a first seal and a second seal of the seal assembly.

13. The method of claim 10, further comprising supplying the shear thickening fluid into the volume through one or more ports of a seal carrier of the seal assembly.

14. The method of claim 10, wherein the shear thickening fluid comprises silicon suspended in glycol.

15. The method of claim 10, further comprising moving the frustoconical member relative to the seal assembly when the shear thickening fluid is in the substantially fluid state.

16. The method of claim 10, wherein the volume is reduced as the frustoconical member is moved underneath the seal assembly, thereby compressing the shear thickening fluid.

17. The method of claim 10, further comprising transmitting the force from the seal assembly to shear a releasable member and force a slip assembly radially outward into engagement with the wellbore.

18. The method of claim 17, further comprising subsequently forcing the frustoconical member underneath the seal assembly to force the seal assembly radially outward into engagement with the wellbore.

19. The method of claim 10, wherein the force comprises a mechanical, hydraulic, pneumatic, or electrical force.

* * * * *